United States Patent [19]

Nuckel, Jr.

[11] Patent Number: 4,602,469

[45] Date of Patent: Jul. 29, 1986

[54] ROOFING/SIDING SYSTEM AND LOCK SEAM THEREFOR

[76] Inventor: William H. Nuckel, Jr., 291-½ W. 12th St., New York, N.Y. 10014

[21] Appl. No.: 620,872

[22] Filed: Jun. 15, 1984

[51] Int. Cl.[4] ..... E04D 1/34

[52] U.S. Cl. ..... 52/520; 52/536

[58] Field of Search ..... 52/536, 520, 478, 460, 52/462, 533, 543, 545, 539

[56] References Cited

U.S. PATENT DOCUMENTS

| | | | |
|---|---|---|---|
| 4,106,250 | 8/1978 | Cummings et al. | 52/539 X |
| 4,114,340 | 9/1978 | Dean et al. | 52/520 |
| 4,400,924 | 8/1983 | Andrews | 52/466 |
| 4,495,743 | 1/1985 | Ellison et al. | 52/520 |

OTHER PUBLICATIONS

Metaline TM Roof Systems brochure.

*Primary Examiner*—J. Karl Bell

*Attorney, Agent, or Firm*—Stiefel, Gross, Kurland & Pavane

[57] ABSTRACT

A roofing/siding system and panels for use therein are provided. Each panel has a batten along one edge which includes a lock lip. Each panel also has a lock-seam along the other edge for receiving the lock lip of an overlapping batten of an adjacent panel. The panels are secured to a substrate by clips having hook shaped portions which engage the lockseams.

22 Claims, 9 Drawing Figures

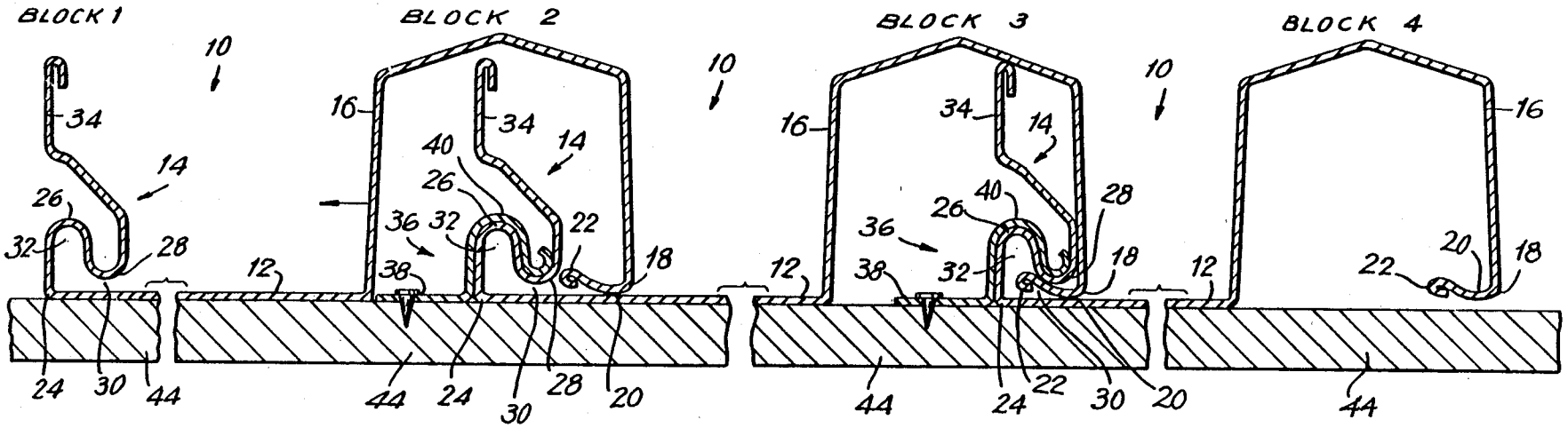
FIG. 1
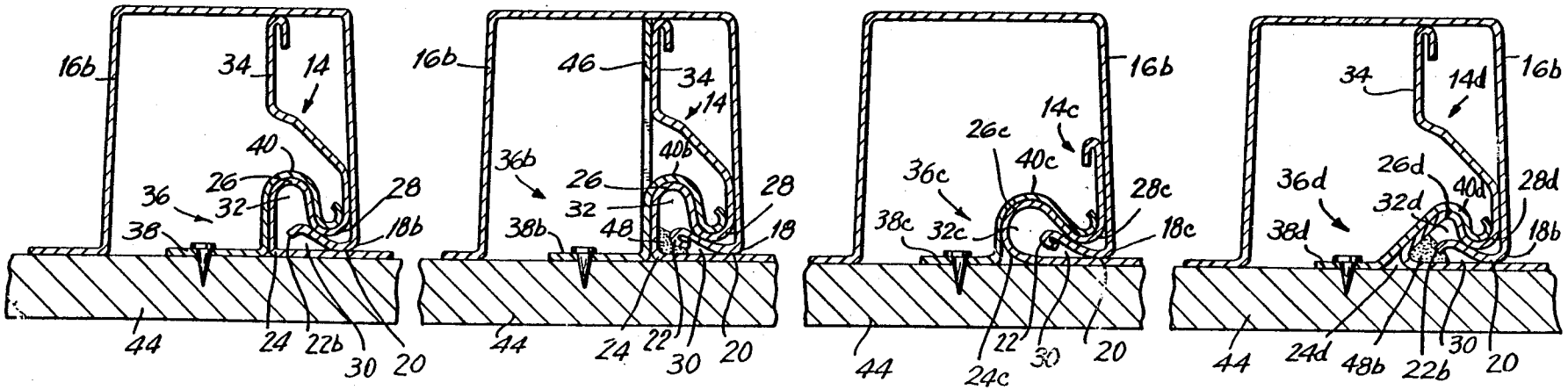
FIG. 2
FIG. 3
FIG. 4
FIG. 5

FIG. 6
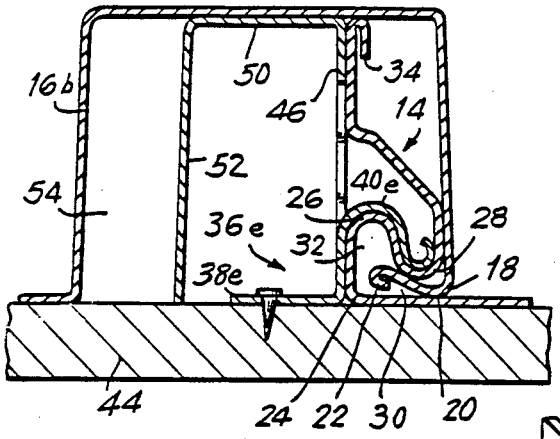
FIG. 7
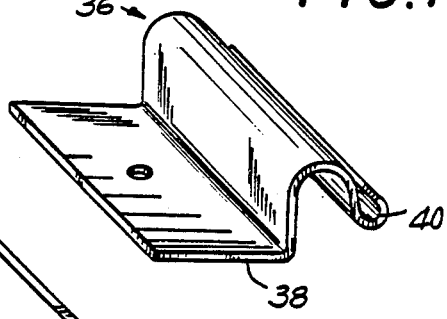
FIG. 8
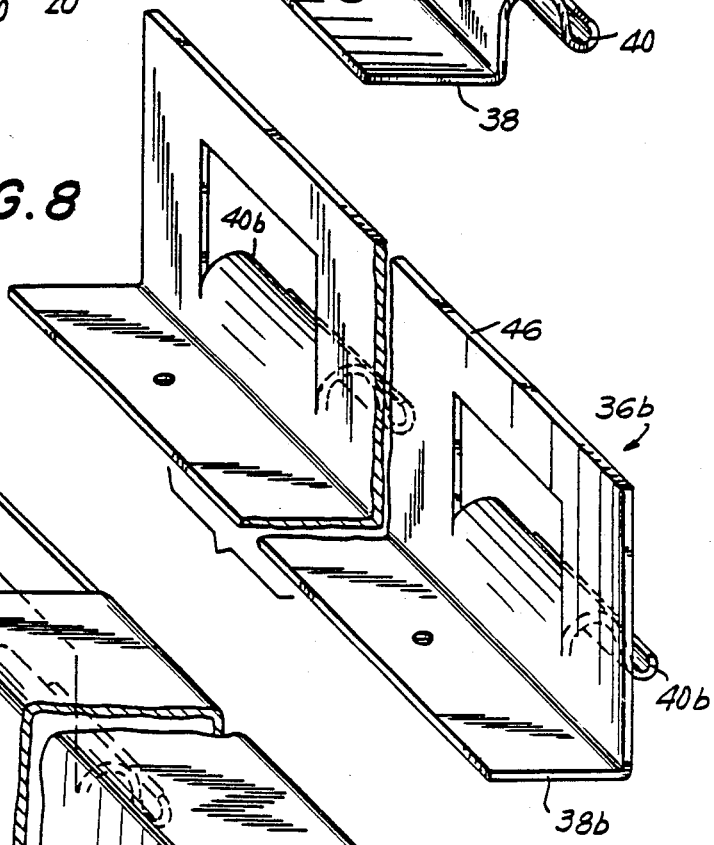
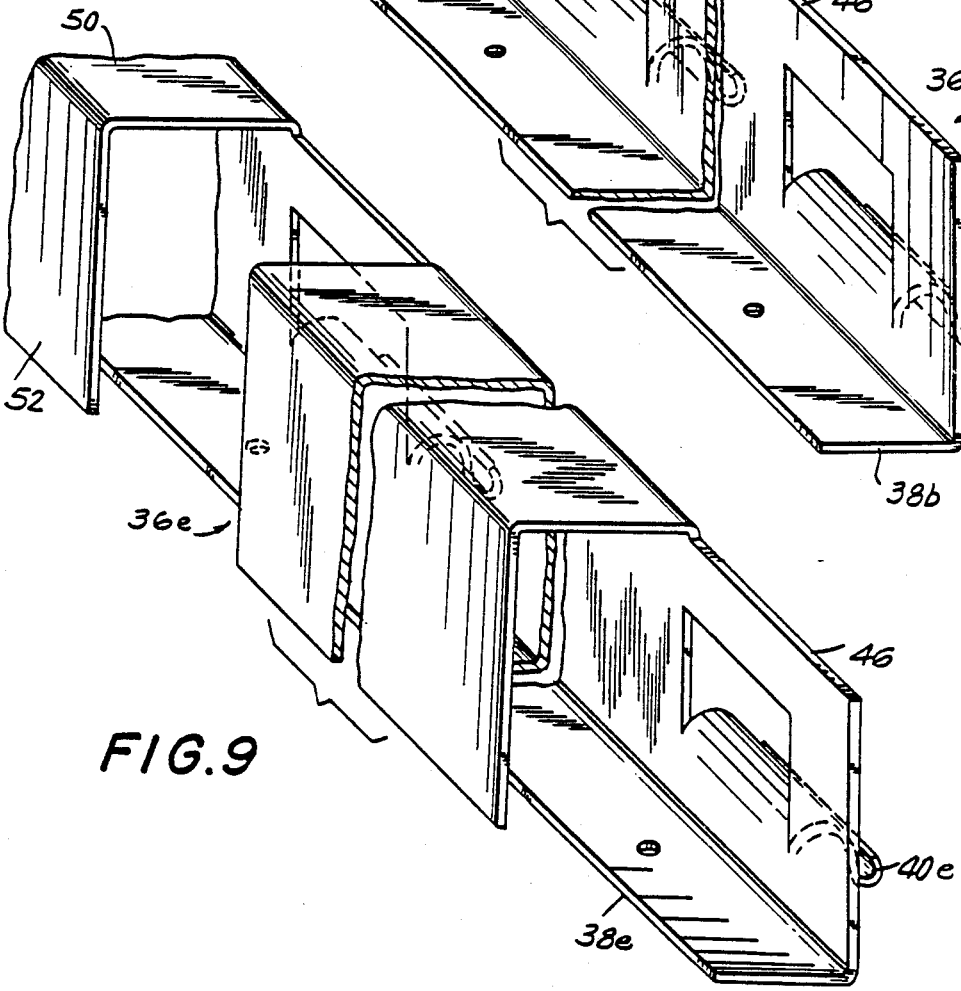
FIG. 9

ROOFING/SIDING SYSTEM AND LOCK SEAM THEREFOR

TECHNICAL FIELD

This invention relates to roofing/siding systems employing a plurality of elongate panels to form a complete covering for a roofing/siding substrate.

BACKGROUND ART

In systems of this type, the individual panels are placed over the substrate and clipped to it. The panels are then joined by seams along their adjacent edges. The seams are covered by battens.

In some systems, the batten clips over adjoining edges of panels and forms a separate element. See for example, Andrews, U.S. Pat. No. 4,400,924.

In improved systems, the batten is made an integral part of the panel to save construction time. See, for example, the METALINE TM roof system of Astraline Corporation, Teterboro, N.J. In this later type of system, the panel has two distinct longitudinal edges, a longitudinal edge being defined as an edge running along the length of the panel.

One longitudinal edge is bent to form the aforementioned batten. The opposite longitudinal edge is bent to form a lockseam.

A lockseam is a bend curving back on but not actually touching the panel. The resulting gap which lies between the bend and the panel is intended to receive a corresponding lock lip, which protrudes from the end of the batten of an adjacent panel.

In the METALINE TM system, there is also a water dam behind the lock gap in the lockseam. Each panel in the METALINE TM system is secured to the substrate by clips which hook over the top of the water dam.

In some environments, strong wind uplift and shear forces may act on the panels. These forces are transferred both to the lockseams holding the panels together and the clips holding the panels to the substrate. The combination of the vertical uplift and horizontal wind shear forces may eventually cause the panels to twist out of the holding clips. The lockseams may also deform in the area of the lock gaps permitting the lock lips of adjacent panels to pop out.

Hence, in environments where strong wind uplift and shear forces may be encountered regularly, an improved lockseam and clip arrangement is needed.

It is also desirable to provide a lockseam with a receiving space suitable for receiving a bead of caulking compound and into which the lock lip may penetrate after insertion thereof through the lock gap. This bead of caulking compound is beneficial because it provides an added measure of protection against water infiltration through the lockseam. The caulking also acts as an adhesive to help hold the lock lip in place.

In addition, in some roofing situations, people may need to walk on the roof, to service roof mounted equipment. When roof panels are made out of soft metals like zinc and copper, additional support may be needed under the battens to prevent deformation. However, the support must not dramatically increase construction time.

SUMMARY OF THE INVENTION

One object of this invention is to provide a novel lockseam arrangement for panels used in roofing/siding systems which is capable of withstanding the effects of strong wind uplift and shear forces.

Another object of this invention is to provide a space in the lockseam for receiving a bead of caulking compound to seal the lockseam against water infiltration and provide adhesion for holding a lock lip in place.

Another object of this invention is to provide a batten support means integral with the clip means used to secure the panels to the substrate for providing additional support for the battens without dramatically increasing construction time.

BRIEF DESSCRIPTION OF THE DRAWINGS

The novel features of the present invention along with the objects and advantages thereof will be better understood with reference to the following description considered in connection with the accompanying drawings in which several preferred embodiments are illustrated. However, it should be understood that the drawings are purely illustrative and descriptive only and are not intended as a definition of the limits of the invention.

FIG. 1 is a vertical cross sectional view of a portion of a roofing/siding system in construction, said system being built in accordance with the present invention and showing one embodiment of the lock seam-clip arrangement of the present invention;

FIG. 2 is a vertical cross sectional view of another embodiment of the lock seam-clip arrangement of the present invention showing a lock seam with a water dam and a clip;

FIG. 3 is a vertical cross sectional view of yet another embodiment the lock seam-clip arrangement of the present invention showing the lock seam and water dam of FIG. 2 used in conjunction with a clip having a support member;

FIG. 4 is a vertical cross sectional view of a further embodiment of the lock seam-clip arrangement of the present invention showing a modified lock seam and clip;

FIG. 5 is a vertical cross sectional view of still a further embodiment of the lock seam-clip arrangement of the present invention showing a modified lock seam with a water dam and a modified clip;

FIG. 6 is a vertical cross section of another embodiment of the lock seam-clip arrangement of the present invention showing a lock seam and water dam in conjunction with a clip support frame;

FIG. 7 is a perspective view showing the clip employed in FIGS. 1 and 2;

FIG. 8 is a perspective view of the clip employed in FIG. 3; and FIG. 9 is a perspective view of the clip employed in FIG. 6.

BEST MODE FOR CARRYING OUT THE INVENTION

The roofing/siding system of the present invention employs a multiplicity of separate panels laid side by side on a substrate and joined together by seams along their longitudinal edges.

Referring in detail to FIG. 1, a roofing/siding system is depicted employing the panels and clip means of the present invention. For simplicity of illustration only three panels are shown. However, it should be understood that in an actual roofing/siding sytem many more side-by-side panels will commonly be employed. It should also be noted that in order to depict the three panels with sufficient clarity it is necessary to present the system as a series of four broken figures. Each of the three breaks in the drawing divides a single panel into two portions. In describing FIG. 1 the broken portions shall be referred to as blocks 1–4 respectively with block 1 being farthest to the left and block 4 being farthest to the right in FIG. 1.

Each panel 10 has a pan 12 with a pair of longitudinal edge portions which are configured into a lock seam 14 and a batten member 16, as will be more fully described hereinafter. The panel width or pitch, which is the distance between the right hand most side of lock seam 14 and the right hand most side of batten member 16, may be 12 inches, 16 inches or 20 inches or any other desired width. The panel width will depend upon aesthetic as well as structural considerations (i.e. the amount of clips desired per area of coverage). The panel length is dependent on the dimensions of the substrate being covered, it being preferred to use single panels in the longitudinal direction to avoid seams between the ends of longitudinally aligned panels. Materials of construction for the panels are preferably aluminum, steel, zinc or copper, although other metals or stiff plastic may be used. The panels may be shaped to form the lock seams and battens; the preferred thickness being in the range of 0.015 up to 0.050 inches. By shaping is meant roll-forming or any other method of bending as is commonly employed in the shaping of sheet metal, as well as extrusion of the panel in the bent configuration, especially (but not exclusively) when the panel is made of plastic. The panels preferably are substantially planar although they may incorporate ridges, designs, etc.

The lock seam 14 is formed out of one longitudinal edge portion of a pan 12. A longitudinal edge portion is the portion of the panel running along and adjacent the long dimension of the panel. In FIG. 1 the longitudinal edge portion would run along a line perpendicular to the plane of the drawing. The lock seam 14 is illustrated by itself in block 1 of FIG. 1. The lock seam 14 begins with a transition portion 24 which bends upwards from the plane of pan 12 and in the preferred embodiment is at about a 90° angle as shown. However, the transition portion may be at an angle of less than or greater than 90° (see FIGS. 4 and 5 and description below) and may be a sharp bend as shown in FIG. 1 or a smooth curve (see FIG. 4). Following the transition portion 24 is an arch portion 26, which in the preferred embodiment is semicircular in cross section as shown. The arch portion 26 curves back and down towards the pan 12 of panel 10. Following the arch portion 26 is the trough portion 28. In the preferred embodiment, the trough portion 28 is also semicircular in cross section as shown in FIG. 1. However, in other embodiments the arch and trough portions might be V-shaped or of other shapes so long as they substantially define an arch and a trough.

In the preferred embodiment the lock seam 14 also has a water dam 34 as shown in FIG. 1. The water dam 34 is optional, but is preferred because it provides an additional barrier to water infiltration and, as will be described below may have a reinforcing function. The trough portion 28 of lock seam 14 closely approaches but does not touch the pan 12 such that a gap 30 is formed therebetween. The gap 30 is about one-fifth inch high in the preferred embodiment.

Inside the gap 30 and beneath the arch portion 26 is a receiving space 32. The receiving space 32 provides a space or cavity for receiving caulking compound during fabrication of the panel 10. This affords time savings during construction in applications where caulking is desired by eliminating the need to caulk each panel 10 during installation.

The batten member 16, which is shown by itself in block 4 of FIG. 1 (farthest to the right), is formed from the other longitudinal edge portion of pan 12. The batten member 16 may be gabled (as shown in FIG. 1), rectangular, trapezoidal, inverted U-shaped, inverted V-shaped, or of other ornamental shapes. Batten member 16 terminates in a lock lip 18. As shown in FIG. 1 and as presently preferred, the lock lip 18 has a neck 20 and a lock head 22 at its terminal end. The lock head 22 may be a reverse bend as shown, it being understood that the bend may be made either up or down. It may also be a separate tip affixed to the neck 20. In the preferred embodiment, the lock head **22*b* is formed as a straight edge to conserve material (see FIGS. 2 and 5**).

In FIG. 1, the neck 20 and lock head 22 are so designed that the lock lip 18 can be inserted through the gap 30 of lock seam 14 of an adjacent panel 10. The lock head 22 must pass through gap 30 into receiving space 32 where it then rises up towards arch portion 26 so as to fit snugly behind the trough portion 28 of the interfitting lock seam (see block 3 in FIG. 1). The neck 20 and sidewall of batten member 16 must be resiliently flexible so that as lock lip 18 is inserted through gap 30, lock head 22 will deflect down towards pan 12 and then flex back up to a position wherein lock head 22 snugly seats against trough portion 28 of the interfitting lock seam.

By insertion of the lock lip 18 of one panel 10 into the gap 30 of lock seam 14 of an adjacent panel 10 the two panels are brought into sealing relationship with one another.

In block 2 of FIG. 1 (second from the left) a batten member 16 of panel 10 is shown overlapping lock seam 14 of an adjacent panel 10 prior to insertion of the lock lip 18 through gap 30, prior to completion of the joint. During construction, the panel 10 whose lock seam 14 is to receive the lock lip 18, is clipped to substrate 44 preferably prior to the insertion step. As shown in block 2 of FIG. 1, this clipping is performed by a clip means 36 having a hook-shaped clip 40 which overlies the arch portion 26 and projects down into trough portion 28 of lock seam 14.

In the preferred embodiment the curvature of the clip 40 matches the curvature of arch portion 26 and trough portion 28 as shown in FIG. 1. This embodiment of clip means 36 is preferred because the grip of a curved clip on a like curved bend as shown in FIG. 1 is inherently strong.

As will be shown more fully hereinafter, a variety of clip shapes may be used. It is not necessary for the clip 40 to match the curvature of arch portion 26 or trough portion 28. It is only required that the clip 40 hook over the top of arch portion 26 to restrain the motion of lock seam 14 in the horizontal and vertical directions.

This type of grip will restrain motion in the vertical and horizontal directions (in the plane of the drawing of FIG. 1). However, expansion and contraction due to thermal stresses in the longitudinal direction (perpendicular to the plane of the drawing of FIG. 1) will not be hindered. In this manner, trough portion 28 of lock seam 14 is prevented from flexing relative to pan 12 of panel 10. This eliminates one of the problems caused by excessive wind shear and vertical uplift forces, namely deformation of lock seam 14 which, in the prior art, may allow lock lip 18 to pop out.

In addition, since the clip 40 hooks over the top of arch portion 26 rather than over the top of water dam 34, another problem sometimes encountered in the prior art is eliminated. Specifically, in the clip arrangement as shown in FIG. 1, there is much less leverage exerted by the panel on the clip 40 than in prior art systems since the clip is much closer to the plane of panel 10. This substantially reduces the likelihood of panel 10 twisting out of clip 40 which may be a problem if the clip were to act much higher up, as by overlapping the water dam 34 instead.

The clip means 36 has a base 38 for attachment to substrate 44. The base 38 may be attached by any conventional fastening means including, but not limited to, nails and screws.

As described earlier, during construction a panel 10 is placed on substrate 44 with its batten member 16 overlapping a lock seam 14 of an adjacent panel 10 as shown in block 2 of FIG. 1. The panel 10 is then pulled toward lock seam 14 (which in FIG. 1 is to the left) for inserting lock lip 18 through gap 30 of lock seam 14 into the receiving space 32 whereby to complete the joint as in block 3 of FIG. 1.

Preferably prior to each panel being brought into sealing relationship with an adjacent panel by the procedure illustrated in blocks 2 and 3 of FIG. 1, the lock seam 14 of the panel 10 is clipped to substrate 44 by clip means 36. Thus, as construction continues, lock seam 14 of panel 10 shown in block 1 of FIG. 1 (farthest to the left) will be clipped to substrate 44 by clip means 36 (not shown in block 1) and a batten member 16 of an adjacent panel 10 (which would be to the left of FIG. 1) will be placed over the lock seam 14 of panel 10 and inserted therein as previously described. This procedure may be continued indefinitely as successive adjacent panels are added.

It should be noted that in the preferred embodiment the top of the water dam 34 contacts batten member 16 to provide a tall water dam as well as additional support for the batten against downward pushing forces as may be encountered, for example, by a workman stepping on the batten 16. However, the water dam may take on a variety of shapes or heights other than that shown in FIG. 1 or may be eliminated entirely as shown in FIG. 4.

Referring now to FIG. 2, a modified lock seam arrangement is shown. The batten member **16*b* of FIG. 2 differs from batten member 16 shown in FIG. 1 in that batten member 16*b* in FIG. 2** has a flat top as opposed to a gabled top. However, as previously described, the batten member may take on a variety of shapes other than those shown and described.

Another important difference between the lock seam arrangement shown in FIG. 2 and that shown in FIG. 1 is that the lock head **22*b* of lock lip 18*b* is blunt and not curved back on lock lip 18*b*. Either type of lock head 22 or 22*b*** may be used in any form of the present invention.

The clip means 36 in FIG. 2 may be identical to the clip means 36 shown in FIG. 1. Such a clip means 36 is further illustrated in FIG. 7. In the preferred embodiment a plurality of clip means 36 are placed along the lock seam 14 preferably at two to four foot spacing intervals, although other spacings may be used. Alternatively, the clip means 36 may be continuous in the longitudinal direction to grip the lock seam 14 over its entire length or some continuous portion thereof.

FIG. 3 shows another embodiment of the lock seam arrangement of the present invention. As shown in FIG. 3 a bead of caulking 48 is placed in the receiving space 32 of lock seam 14. As a suitable caulking for this purpose, a non-skinning caulking is preferably employed, such caulking being known in the art. An example of a satisfactory non-skinning caulking is a butyl rubber sealant, such as, for instance, Pecora DR 96 curtain wall sealant, manufactured by Pecora Corporation, Harleysville, Pa. The bead of caulking 48 performs two functions. It helps to seal against water infiltration and acts as an adhesive between lock lip 18 and lock seam 14.

The clip means **36*b* may also embody an upstanding reinforcing member 46, as shown in FIG. 3. This reinforcing member extends up to the top of batten member 16*b* (or if used in FIG. 1, batten 16) and provides reinforcement therefor. In the preferred embodiment the reinforcing member 46 is in contact with the back of water dam 34 to provide reinforcement for the water dam 34 as well as providing reinforcement to the batten which, in FIG. 3, is added to the batten reinforcement function of the water dam 34 itself. Of course, if no underlying reinforcement for the batten is required, then the water dam and/or the clip can stop short of the top of the batten, as is shown in FIG. 4. Clip means 36*b* is further illustrated in FIG. 8**.

FIG. 8 shows a perspective view of the clip means used in FIG. 3. As shown, the clip means **36*b* has two clips 40*b*. A base 38*b* is provided for attachment to substrate 44. Clip means 36*b* also has a reinforcing member 46, preferably proportioned to engage the inside of the top of the overlying batten. A plurality of clip means 36*b* may be placed end on end to run the entire longitudinal length of panel 10. Alternatively, clip means 36*b* may be a long bar extending the entire length of panel 10 or some continuous portion thereof with clips 40*b* positioned at a preferred 2–4 foot spacing along the entire length or at some other suitable spacing. In addition, clip means 36*b* may be formed, as by extruding, with clip 40*b*** extending along its entire length.

FIG. 4 shows yet another embodiment of the lock seam arrangement of the present invention. As previously described, water dam 34 is optional in the lock seam of the present invention. As shown in FIG. 4 water dam 34 has been omitted from lock seam **14*c*. Also, and as shown in FIG. 4, the transition portion 24*c* is not at a 90 degree angle but at an angle of less than 90 degrees from the plane of panel 10**. Such transition portions may be employed in the other embodiments as well in lieu of right or obtuse angled transition portions.

Referring to FIG. 5, this embodiment is in most respects the same as those shown in FIGS. 1, 2, 3 and 4, save that the transition portion **24*d*** is at an obtuse angle greater than 90° . Such an angle for the transition portion may also be employed in the other embodiments, if desired.

Referring now to FIG. 6, the embodiment shown is generally similar to that of FIG. 3 excepting that additional reinforcement to the batten member **16*b* is provided beyond that afforded by the water dam 34 and the reinforcing member 46 of FIG. 3**.

In FIG. 6 the clip means **36*e* has a reinforcing member 46 which is bent back on itself so that the top part of the reinforcing member 50 lies in contact with the underside of the top of the batten member 16*b*. The reinforcing member 46 also has a support leg 52 extending back down into operative engagement with substrate 44, either by directly engaging the substrate (as shown) or by engaging the base 38*e* of the clip means 36*e*, or a shim. This arrangement provides more surface contact with batten member 16*b* than previous reinforcing arrangements shown and described and additional vertical support for the batten. This type of lock seam arrangement is preferred whenever the batten member will be subjected to heavy walking loads, irrespective of whether the structure is that of FIGS. 1, 2, 3, 4, 5 or 6. It should be noted that a space 54 must be provided between the return leg 52 of the reinforcing member and the vertical wall of the batten so that, during construction, the batten member may be slipped over lock seam 14. Depending on the flexibility of the material used to construct the panel 10, the gap 54 should be wide enough to alleviate the need for permanently deforming batten member 16***b* in order to get the lock lip 18 around lock seam 14 and inserted through gap 30 during construction.

FIG. 9 shows a perspective view of clip means 36*e* previously described in FIG. 6. Clip means 36*e* is a modification of clip means 36*b* shown in FIG. 8. As already noted, the reinforcing member 46 is bent back on itself to form a top portion 50 and a support leg 52 to provide a stiffer and more dispersed reinforcement for the batten. Top portion 50 preferably conforms in shape to the underside of batten 16*b* (or if used in FIG. 1, batten 16). Clips 40*a* are preferrably spaced 2–4 feet apart (although other suitable spacing may be used) and clip means 36*e* preferrably, although not necessarily, runs the entire length of panel 10.

Alternatively, clip means 36*e* may be extruded, in which case clip 40 is preferably continuous, running along the length of clip means 36*e*. For added support, clip means 36*e* may embody additional support legs 52 or may have a central core within the space defined between base 38*c*, reinforcing member 46, top portion 50 and support leg 52. The central core (not shown) may be hollow or solid and may constitute a separate body or be integrally formed with clip means 36*e*.

Clip means 36, 36*b*, 36*c*, 36*d* and 36*e* may be made out of metal, wood, or rigid plastic; preferrably a stainless steel or CPVC.

It will be recognized that numerous modifications may be made to the present invention without departing from the spirit or scope thereof.

What is claimed is:

1. A panel for a roofing/siding system to overlie and cover a substrate, said system comprising a plurality of such panels in side-by-side interlocking relation, and clip means for securing said panels to said substrate, each of said panels comprising a longitudinally extending pan having a pair of longitudinal edge portions, one of said longitudinal edge portions being bent to form a lock seam and the other of said longitudinal edge portions being bent to form a batten, said batten being configured to cover the lock seam of the adjacent panel in said system, said batten having a free end bent inwardly towards said pan and defining a lock lip, said lock lip having a neck terminating in a lock head; said lock seam comprising a three part bend including a transitional portion extending upwardly from said pan, an arch portion curving away from said transitional portion back and down towards said pan and a trough portion curving away from said arch portion and upwards from said pan, said trough portion and said pan defining a gap therebetween for allowing said head of said lock lip to be inserted between said trough portion and said pan; said pan, said transitional portion and said arch portion defining a receiving space in communication with said gap for receiving the lock head of said lock lip of the adjacent panel, said lock head being no larger than said receiving space, said gap being at least as wide as said neck of said lock lip; said arch and said trough portions being accessible from above for said clip means to hook over said arch portion and down into said trough portion for securing said panel to said substrate and for preventing said trough portion from flexing relative to said pan.

2. The panel according to claim 1, further comprising a water dam integral with said lock seam and extending upwards from said trough portion.

3. A roofing/siding system for covering a substrate, said roofing/siding system comprising a panel according to claim 1, and further comprising clip means including a hook shaped clip member hooking over said arch portion and extending down into said trough portion of said lock seam of said panel for securing said panel to said substrate and for preventing said trough portion of said lock seam of said panel from flexing relative to said pan of said panel.

4. The roofing/siding system according to claim 3, further comprising a water dam integral with said lock seam and extending upwards from said trough portion.

5. A roofing/siding system for covering a substrate, said roofing/siding system comprising first and second panels each according to claim 1, the batten member of said second panel covering said lock seam of said first panel, said lock lip of said second panel being inserted into said lock seam of said first panel to effect a sealing relationship therewith, said roofing/siding system further comprising clip means hooking over said arch portion and extending down into said trough portion of said lock seam of said first panel for securing said first panel to said substrate and for preventing said trough portion of said lock seam of said first panel from flexing relative to said pan of said first panel.

6. The roofing/siding system according to claim 5, each panel further comprising a water dam integral with said lock seam and extending upwards from said trough portion.

7. A roofing/siding system for covering a substrate, said roofing/siding system comprising first, second and third panels, in consecutive side by side relation, each of said panels being a panel according to claim 1, said batten member of said second panel covering said lockseam of said first panel, said batten member of said third panel, covering said lock seam of said second panel, said lock lip of said second panel being inserted into said lockseam of said first panel, and said lock lip of said third panel, being inserted into said lock seam of said second panel, to effect a sealing relationship between said panels, said roofing/siding system further comprising clip means between said first and second panels and between said second and third panels, each of said clip means hooking over said arch portions and extending down into said trough portions of the adjacent lock seam for securing said panels to said substrate and preventing said trough portions of said lock seams of said panels from flexing relative to said two adjacent pans.

8. The roofing/siding system according claim 7, further comprising a water dam integral with said lock seam and extending upwards from said trough portion.

9. The roofing/siding system according to claim 6, wherein said clip means includes a reinforcing member, said reinforcing member extending up to and abutting up against said water dam of said panel, said water dam and said reinforcing member both being in contact with the underside of said adjacent batten member covering said lock seam of said panel for reinforcing said adjacent batten member.

10. The roofing/siding system according to claim 9, wherein said reinforcing member of said clip means is bent back on itself to define a support leg said reinforcing member having a top portion engaging the underside of the top of said batten member, said support leg extending down into operative engagement with said substrate.

11. The panel according to claim 1, wherein said transitional portion extends upwardly from said pan at roughly a 90 degree angle to the plane of said pan.

12. The panel according to claim 1, wherein said transitional portion extends upwardly at an acute angle, less than 90 degrees, relative to the plane of said pan.

13. The panel according to claim 1, wherein said transitional portion extends upwardly at an obtuse angle, greater than 90 degrees, relative to the plane of said pan.

14. The roofing/siding system according to claim 5, wherein said clip means includes a reinforcing member, said reinforcing member extending up to and being in contact with the underside of the top of said adjacent batten member.

15. The roofing/siding system according to claim 14, wherein said reinforcing member of said clip means is bent back on itself to define a support leg, said reinforcing member having a top portion engaging the underside of the top of said batten member, said support leg extending down into operative enagement with said substrate.

16. The panel according to claim 1, wherein said lockseam further comprises a bead of caulking in said receiving space for sealing against water infiltration and providing adhesion for a lock lip inserted therein.

17. The panel according to claim 2, wherein said lockseam further comprises a bead of caulking in said receiving space for sealing against water infiltration and providing adhesion for a lock lip inserted therein.

18. The roofing/siding system according to claim 3, wherein said lockseam further comprises a bead of caulking in said receiving space for sealing against water infiltration and providing adhesion for a lock lip inserted therein.

19. The roofing/siding system according to claim 10, wherein said clip means further comprises a central core shaped to fit within said reinforcing member and being in contact therewith, said central core extending substantially the length of said clip means for providing additional support therefor.

20. The roofing/siding system according to claim 15, wherein said clip means further comprises a central core shaped to fit within said reinforcing member and being in contact therewith, said central core extending substantially the length of said clip means for providing additional support therefor.

21. The roofing/siding system according to claim 19, wherein said central core is solid and is integral with said reinforcing member.

22. The roofing/siding system of claim 20, wherein said central core is solid and is integral with said reinforcing member.

* * * * *